US011235256B1

(12) United States Patent
Middleton

(10) Patent No.: US 11,235,256 B1
(45) Date of Patent: Feb. 1, 2022

(54) TOY VEHICLE AND INTERACTIVE PLAY SURFACE

(71) Applicant: Lance Middleton, Germantown, TN (US)

(72) Inventor: Lance Middleton, Germantown, TN (US)

( * ) Notice: Subject to any disclaimer, the term of this patent is extended or adjusted under 35 U.S.C. 154(b) by 0 days.

(21) Appl. No.: 16/662,314

(22) Filed: Oct. 24, 2019

Related U.S. Application Data

(63) Continuation of application No. 13/856,846, filed on Apr. 4, 2013, now abandoned.

(60) Provisional application No. 61/620,204, filed on Apr. 4, 2012.

(51) Int. Cl.
*A63H 17/26* (2006.01)

(52) U.S. Cl.
CPC ..... *A63H 17/26* (2013.01)

(58) Field of Classification Search
CPC ..... A63H 17/00; A63H 17/004; A63H 17/26; A63H 17/36; A63H 18/00; A63H 18/06
USPC ..... 446/431, 137, 444, 450, 451, 452, 453, 446/465
See application file for complete search history.

(56) References Cited

U.S. PATENT DOCUMENTS 622,354 A * 4/1899 Harvey ..... A63F 7/044 273/113
811,775 A * 2/1906 Keen ..... A63H 29/08 446/169
828,995 A 8/1906 Ayers et al.
1,254,428 A 1/1918 Myers
1,272,588 A 7/1918 Buchanan
1,494,963 A 5/1924 Smith
1,614,471 A 1/1927 Hayashi
1,672,242 A 6/1928 Bennett
2,064,309 A * 12/1936 Lohr ..... A63H 17/25 446/272
2,218,207 A * 10/1940 Herzinger ..... A63H 11/08 446/324
2,585,780 A 2/1952 Johnson
2,639,777 A 5/1953 Dull
2,751,707 A 6/1956 Kask
2,784,527 A 3/1957 Sarff
3,073,598 A 1/1963 Tiikkainen
3,462,148 A * 8/1969 Fors ..... A63F 7/044 273/116
3,519,273 A 7/1970 Viby
3,646,706 A * 3/1972 Adickes ..... A63H 18/026 446/465
3,733,739 A 5/1973 Terzian
3,842,532 A * 10/1974 Nielsen ..... A63H 18/08 446/470
3,927,620 A 12/1975 Clapham
4,052,082 A 10/1977 Jones et al.
4,076,263 A 2/1978 Rand
4,149,735 A 4/1979 Blackburn et al.
4,168,076 A 9/1979 Johnson
(Continued)

FOREIGN PATENT DOCUMENTS

GB 197110 A 5/1923

*Primary Examiner* — Joseph B Baldori
(74) *Attorney, Agent, or Firm* — Ulmer & Berne LLP

(57) ABSTRACT

A toy vehicle is enabled to rotate or turn down a gradient, leading with the end of the vehicle having the greatest tendency to slide or translate laterally. The steerable toy vehicle is enabled for interactive play on a play surface dynamically oriented by the user.

17 Claims, 11 Drawing Sheets

(56) References Cited

U.S. PATENT DOCUMENTS 4,213,266 A * 7/1980 Hyland ..... A63H 15/08 446/431
4,238,904 A 12/1980 Lang
4,257,605 A 3/1981 Bancroft
4,288,088 A 9/1981 Harrison
4,314,422 A 2/1982 Wexler
D273,042 S 3/1984 Jackson
4,522,607 A 6/1985 Kilroy et al.
4,564,162 A 1/1986 Grimm
4,568,305 A 2/1986 De Anda et al.
4,599,077 A 7/1986 Vuillard
4,850,931 A 7/1989 Auer
4,952,191 A 8/1990 Martinez
5,041,049 A * 8/1991 Wax ..... A63H 15/00 446/289
5,100,360 A * 3/1992 Entzel ..... A63H 29/08 446/169
5,397,137 A 3/1995 Pellegrini et al.
5,575,702 A * 11/1996 Silvious ..... A63F 7/3622 446/431
5,653,171 A 8/1997 Lebron et al.
5,724,074 A * 3/1998 Chainani ..... A63H 17/395 345/474
5,928,055 A 7/1999 Gramsch
6,071,173 A * 6/2000 Kelley ..... A63H 17/00 446/431
6,116,621 A 9/2000 Flater
6,254,113 B1 7/2001 Dornan
6,273,779 B1 8/2001 Boulaire
6,367,828 B1 4/2002 Mandic
6,491,308 B1 12/2002 Bakx
6,508,335 B2 1/2003 Zinanti
6,568,695 B2 5/2003 Dornan
6,648,722 B2 11/2003 Lynders et al.
7,018,266 B2 * 3/2006 Sinisi ..... A63H 17/26 244/16
D590,894 S 4/2009 Martino
8,047,556 B2 11/2011 Jang et al.
8,226,096 B2 7/2012 Reyes, Jr.
8,522,928 B2 9/2013 Orcutt
8,550,870 B2 10/2013 Laurienzo et al.
8,708,354 B2 4/2014 Young
8,910,958 B2 12/2014 Smith
9,566,532 B1 * 2/2017 Walterscheid ..... A63H 15/04
2001/0052683 A1 12/2001 Vance
2002/0070514 A1 6/2002 Costa, Jr. et al.
2002/0153686 A1 10/2002 Todd
2004/0061295 A1 4/2004 Lester
2006/0009120 A1 1/2006 Toriyama et al.
2009/0149112 A1 6/2009 Clark, Jr. et al.
2009/0256325 A1 10/2009 Dickie
2010/0081358 A1 4/2010 Yang
2010/0171280 A1 7/2010 Hadley
2011/0028069 A1 2/2011 Norman et al.
2011/0079976 A1 4/2011 Seip
2011/0104982 A1 * 5/2011 Koehl ..... A63H 17/28 446/465
2012/0009846 A1 1/2012 Miller
2012/0091674 A1 4/2012 Kartalopoulos
2013/0026728 A1 1/2013 Genov et al.
2013/0084774 A1 4/2013 Mimlitch, III et al.
2013/0084775 A1 4/2013 Mimlitch, III et al.
2013/0090037 A1 4/2013 Mimlitch, III et al.
2013/0171910 A1 7/2013 Mimlitch, III et al.

* cited by examiner

TOY VEHICLE AND INTERACTIVE PLAY SURFACE

CROSS REFERENCE TO RELATED APPLICATIONS

This application is a continuation of U.S. patent application Ser. No. 13/856,846, filed Apr. 4, 2013, entitled "Toy Vehicle and Interactive Play Surface," which claims the benefit of U.S. Provisional Patent Application Ser. No. 61/620,204, filed Apr. 4, 2012, the disclosure of each of which is hereby incorporated by reference in its entirety.

FIELD OF THE INVENTION

The present invention relates to toy vehicles with dynamic behavior, and more specifically, toy vehicles enabled with a means for the user to control speed and direction of toy vehicles on an interactive play surface.

BACKGROUND OF THE INVENTION

With the emergence of radio-control (RC) vehicles, a wide assortment of toy vehicles and models are enabled with the ability for the user to control both speed and direction of the vehicle. This is accomplished with sophisticated and expensive means, to include electronics, servo-motors and an array of mechanical levers, pulleys, and gears. In contrast, many simpler toy vehicles, to include many pocketable and collectable toy cars, are not enabled with a means to interactively control speed and direction on a play surface. Examples of this type of toy are most versions of the typical Hot Wheels® cars. The speed and direction of Hot Wheels® cars are typically controlled by supportive tracks with a width slightly larger than the width of the car.

U.S. Pat. No. 2,784,527 issued to W. M. Sarff on Mar. 12, 9157 describes a Self-Steering Toy Auto with a steering mechanism sensitive to the slope of the play surface. One embodiment discloses a pendulum weight mounted to move in a transverse direction. Another embodiment discloses a pivot and lever combination associated with a front wheel assembly.

U.S. Pat. No. 5,041,049 issued to William C. Wax on Aug. 20, 1991 describes a directional control for small action toys to include a spherical ball lead element and a pair of trailing ground wheels.

U.S. Pat. No. 6,071,173 issued to William J. Kelley on Jun. 6, 2000 describes a miniature toy vehicle manually urged in motion. The toy vehicle rides on a ball bearing in depending relation form the vehicle chassis. The vehicle chassis has a rotative degree of movement about the ball bearing and during its travel will realign itself, if inadvertently released at an angle to the movement path, to further increase the length of travel.

SUMMARY OF THE INVENTION

A present invention is directed to toy vehicles adapted with a sliding element and having a directional bias to turn downwardly toward the direction of an incline. During interactive play, a user is able to control both speed and direction of the steerable toy vehicle on a user manipulated play surface.

BRIEF DESCRIPTION OF THE DRAWINGS

The particular features and advantages of the invention as well as other objects will become apparent from the following description taken in connection with the accompanying drawings in which.

DETAILED DESCRIPTION OF THE PREFERRED EMBODIMENT

Figure 1:
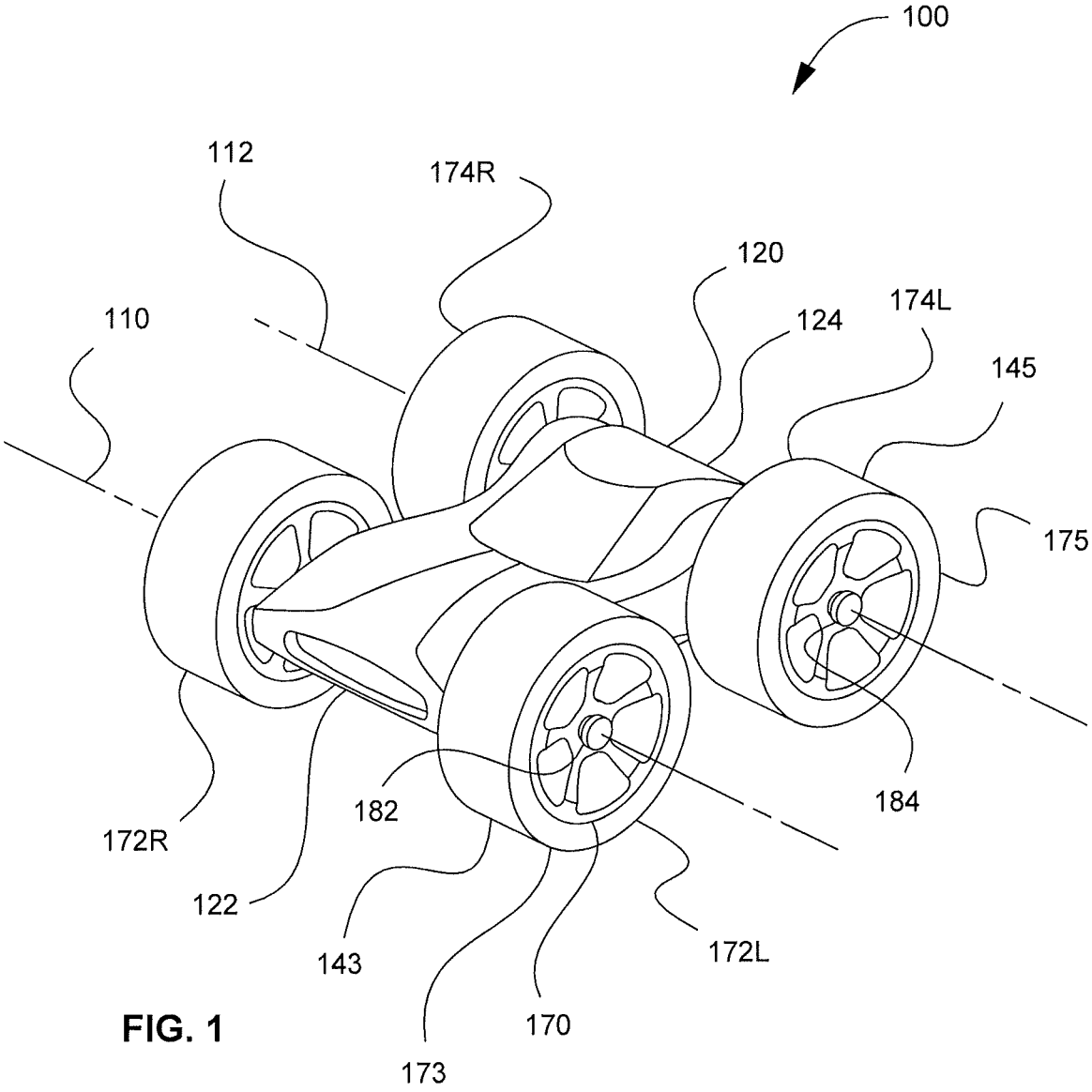
FIG. 1 shows a top perspective view of a first embodiment of a toy vehicle having front tires and rear tires with different lateral sliding characteristics.

FIG. 1 shows an embodiment, toy vehicle 100, to include body 120, front wheels 172L and 172R, and rear wheels 174L and 174R, wherein "L" designates the left side of toy vehicle 100 and "R" designates the right side of toy vehicle 100. Body 120 is associated with a front end 122 and a rear end 124 Toy vehicle 100 is a free rolling vehicle, preferably configured such that each wheel can roll independently. Front wheels 172L and 172R are each comprised of hub 170 and front tire 173. Front wheels 172L and 174R are associated with front axle 182 aligned with front axis 110. Similarly, rear wheels 174L and 174R are each comprised of hub 170 and rear tire 175. Rear wheels 174L and 174R are associated with rear axle 184 aligned with rear axis 112. Hub 170 can be configured to have a thru hole with a diameter larger than front axle 182 and rear axle 184 and assembled using methods well known in the art (e.g., common Hot Wheels® vehicles). As also known in the art, wheels may also be fixed to an axle, wherein the axle rotates with the wheels. To further define functional elements of toy vehicle 100, front tires 173 are associated with front contact surfaces 143 and rear tires 175 are associated with rear contact surfaces 145.

Certain inventive aspects allow toy vehicle 100 to turn and travel down the instantaneous gradient of a play surface. A means to enable turning relates to front wheels 172L and 172R having a greater tendency to slide laterally relative to rear wheels 174L and 174R. Alternatively stated, rear wheels 174L and 174R have a greater resistance to lateral sliding relative to front wheels 172L and 172R. The following sections more fully disclose this means of enabling interactive turning of a toy vehicle toward the downward direction of an incline.

Figure 2A:
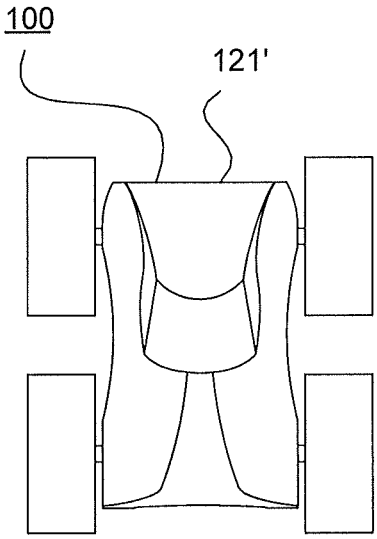
FIG. 2A shows a top view of the toy vehicle of FIG. 1.
Figure 2B:
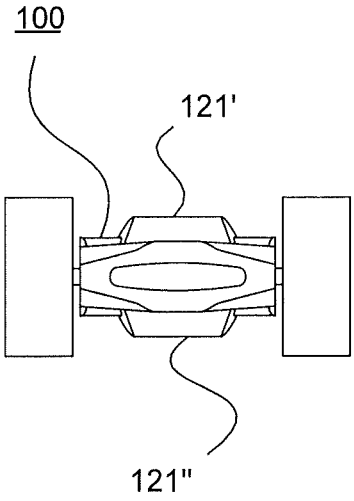
FIG. 2B shows a front view of the toy vehicle shown in FIG. 2A.
Figure 2C:
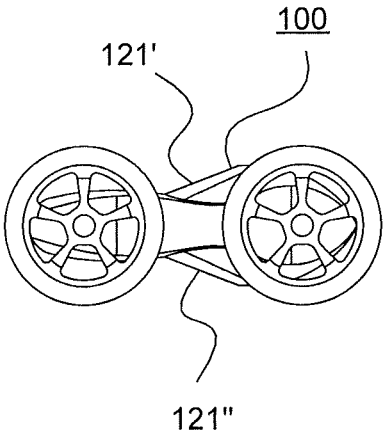
FIG. 2C show a side view of the toy vehicle shown in FIG. 2A.

Toy vehicle 100 of FIG. 1 is configured as a vehicle with two top sides, such that the vehicle is always upright during play. Referring to FIGS. 2A, 2B, and 2C, toy vehicle 100 is shown with first top side 121' and second top side 121".

In continuing reference to toy vehicle 100 of FIG. 1, a means to turn or maneuver the vehicle relates to front wheels 172L/172R advantageously configured to have less sliding resistance relative to rear wheels 174L/174R. As an example, contact surfaces 145 of rear tires 175 can advantageously be constructed from a material with a greater coefficient of friction or a material highly resistant to slipping, such as, rubber. Other suitable materials for rear tires 175 include a wide range of polymers, elastomers, silicones, and composite materials, such as, rubberized plastics. In contrast, contact surfaces 143 associated with front wheels 172L/172R can be comprised of a material with a relatively low coefficient of friction, such as ABS plastic. Other suitable materials for front tires 173 include the plastic materials polyethylene, acetal, and Teflon. Tire tread configuration, or other means, can be used to establish desired lateral sliding characteristics. If front wheels 172L/172R have less resistance to slide laterally, steerable toy vehicle 100 will have a bias to turn front end 122 downwardly toward the direction of an instantaneous gradient. Stated alternatively, if rear wheels 174L/174R have a greater resistance to lateral sliding relative to front wheels 172L/172R, steerable toy vehicle 100 will have a bias to turn front end 122 downwardly toward the direction of an instantaneous gradient.

Figure 3:
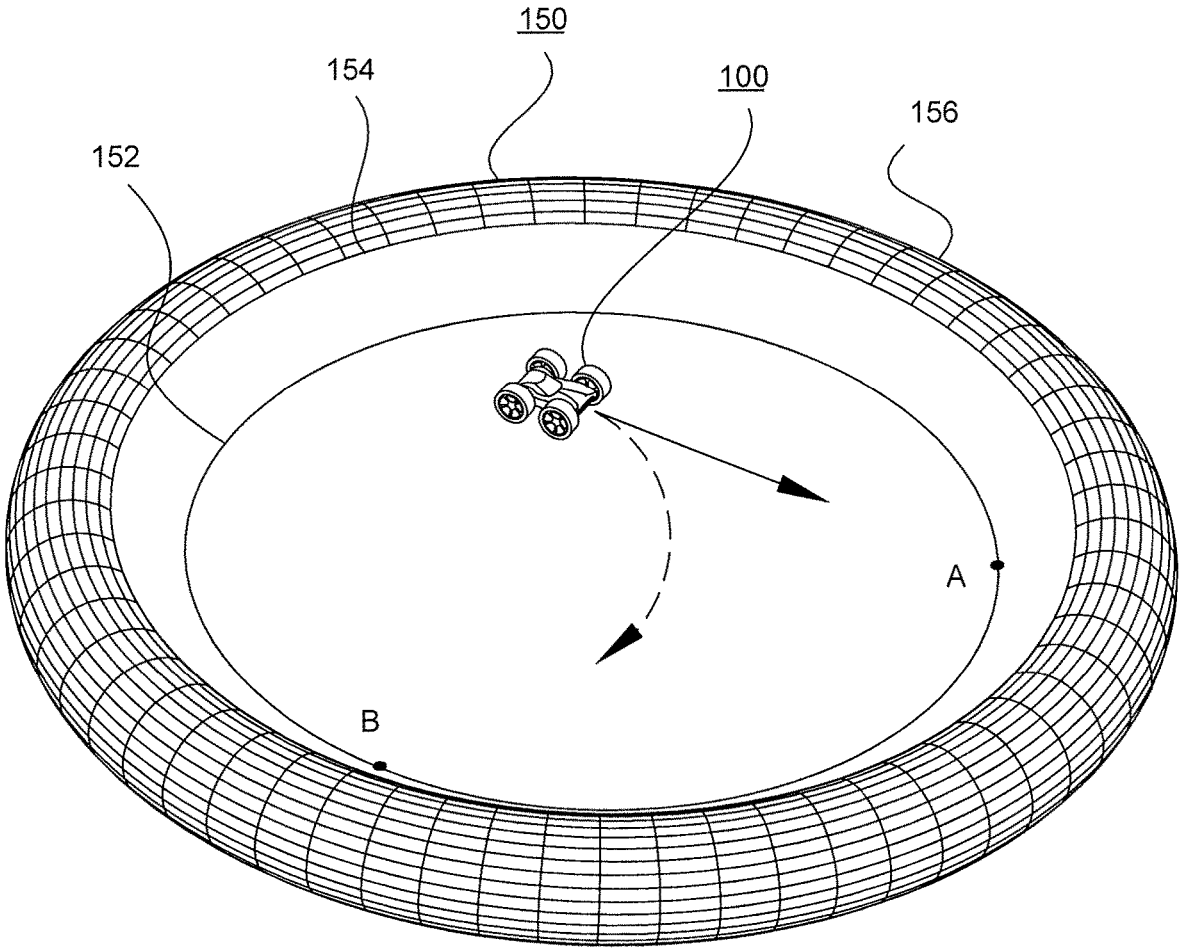
FIG. 3 shows a top perspective view of the toy vehicle of FIG. 1 on a hand-held interactive play surface demonstrating basic maneuvering.

Toy vehicle 100 is enabled for interactive play and may be advantageously combined with a hand-held, tiltable play surface, enabling the user to control both the speed and direction of toy vehicle 100. FIG. 3 shows toy vehicle 100 of FIG. 1 on interactive play surface 150. Interactive play surface 150 is suitably sized to be held and tilted by hand and includes central portion 152, inclined portion 154, and grip portion 156. Consider point A on interactive play surface 150 as the instantaneous lowest point on interactive play surface 150 with steerable toy vehicle 100 initially traveling toward point A, as indicated by the solid arrow. Should the user tilt or manipulate interactive play surface 150 such that point B is now the instantaneous lowest point on interactive play surface 150, toy vehicle 100 will normally change direction toward point B, as indicated by the dashed arrow. Alternatively stated, in response to gravity and instantaneous gradient, toy vehicle 100 has a bias to turn downwardly toward the direction of the instantaneous gradient. By tilting the play surface into various positions, the user can effectively control the speed and direction of steering toy vehicle 100. It is preferred to have all wheels roll independently with respect to each other for best turning performance. As an example, rear wheel 174L may rotate with different rotation velocity than 174R. Further, during a rapid turnaround (180-degree turn), rear wheel 174L may rotate in a different direction than rear wheel 174R. In terms of vehicle dynamics, a wheel slip angle is defined as the angle between a rolling wheel's actual direction of travel and the direction towards which the wheel is pointing. Toy vehicle 100 turns downward in response to an instantaneous gradient when the slip angle of front wheels 172L/172R is greater than the slip angle of rear wheels 174L/174R.

Figure 4:
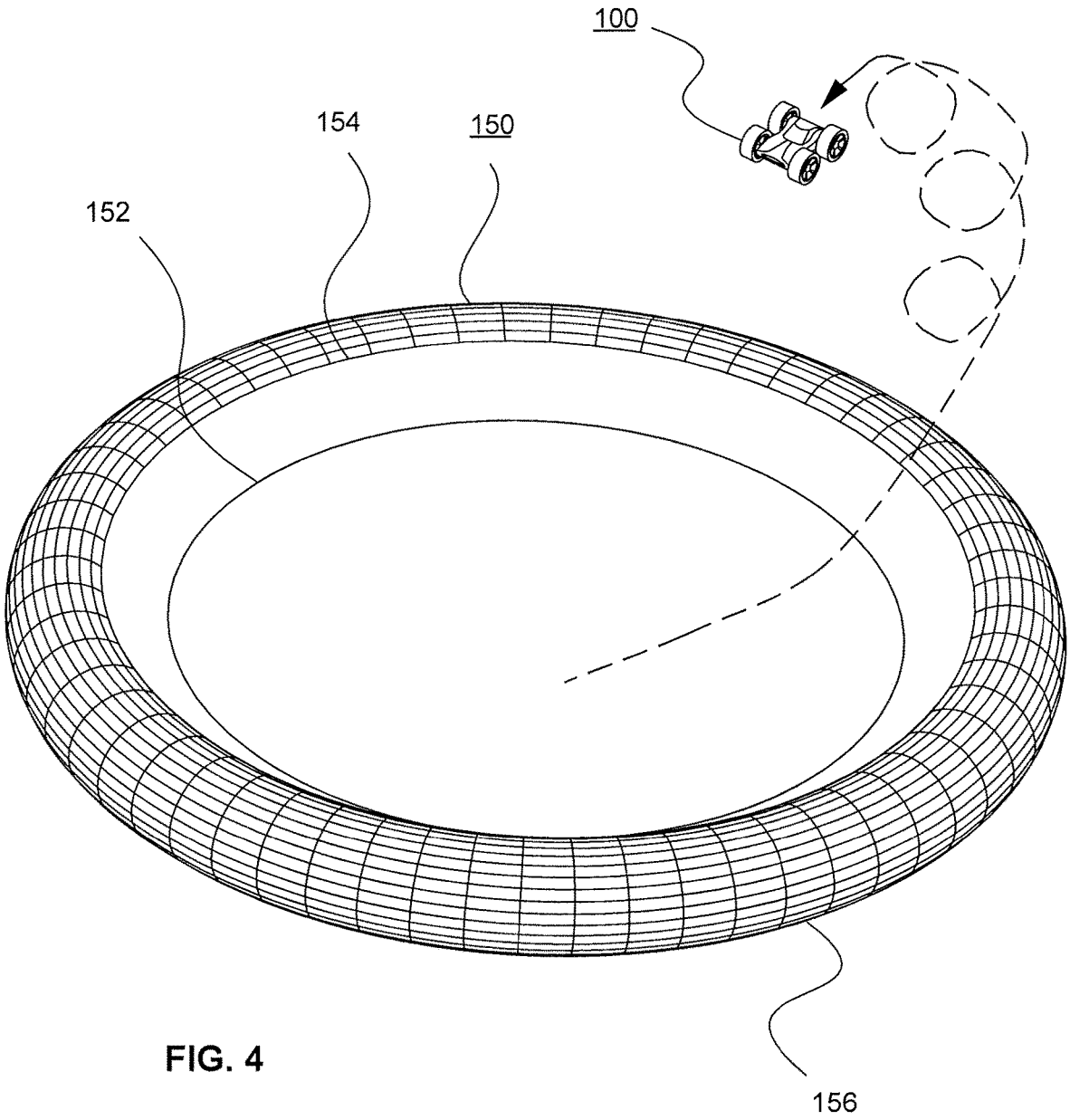
FIG. 4 shows a top perspective view of the toy vehicle of FIG. 1 on a hand-held interactive play surface demonstrating aerial acrobatics.

Numerous play surfaces have been considered to include a variety of shapes, surface textures, stationary downhill race track, rigid tracks, flexible tracks, and multiple level tracks. Numerous play surface accessories have been considered to include a variety jumps, tunnels, bridges, bumps, ramps, multiple levels, hills, and moguls, whether integral with the track or selectively placed by the user. An interactive play surface may be configured in a manner to enable aerial stunts. Aerial maneuvers may be accomplished by incline or the user tossing a toy vehicle into the air by a quick acceleration of at least a portion of the play surface upward. FIG. 4 shows toy vehicle 100 on play surface 150. Incline portion 154 can serve has a banked curve for circumferential travel. As shown in FIG. 4, when toy vehicle 100 travels in a radial direction, incline portion 154 can serve as a ramp for propelling the vehicle into the air to accomplish flips and other aerial stunts, as indicated by the dashed arrow in FIG. 4.

Figure 5A:
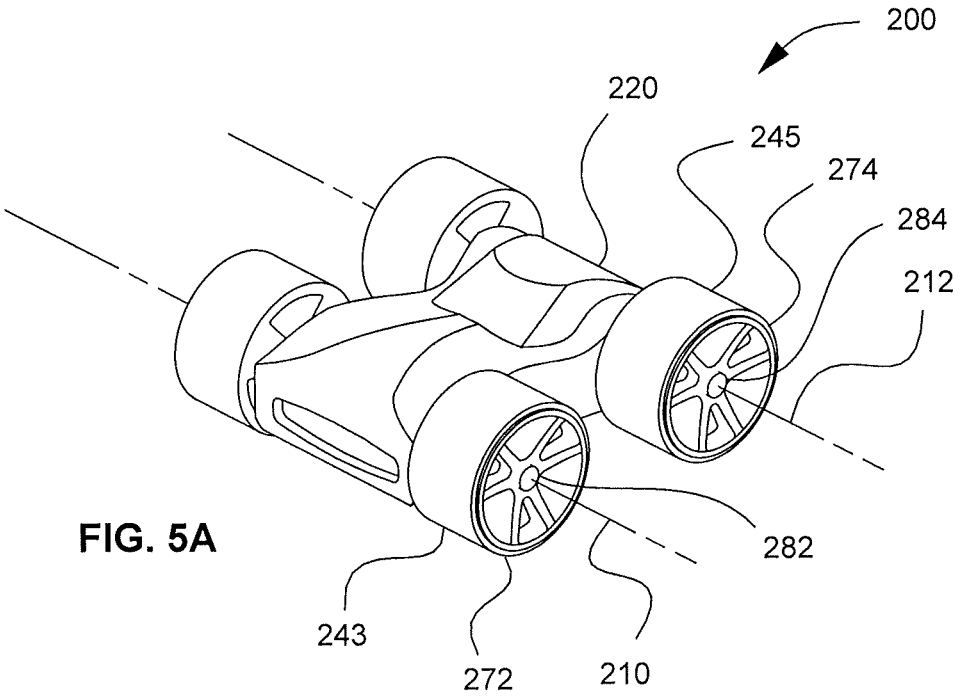
FIG. 5A shows a top perspective view of a second embodiment of a toy vehicle to include a body portion and ball bearing.
Figure 5B:
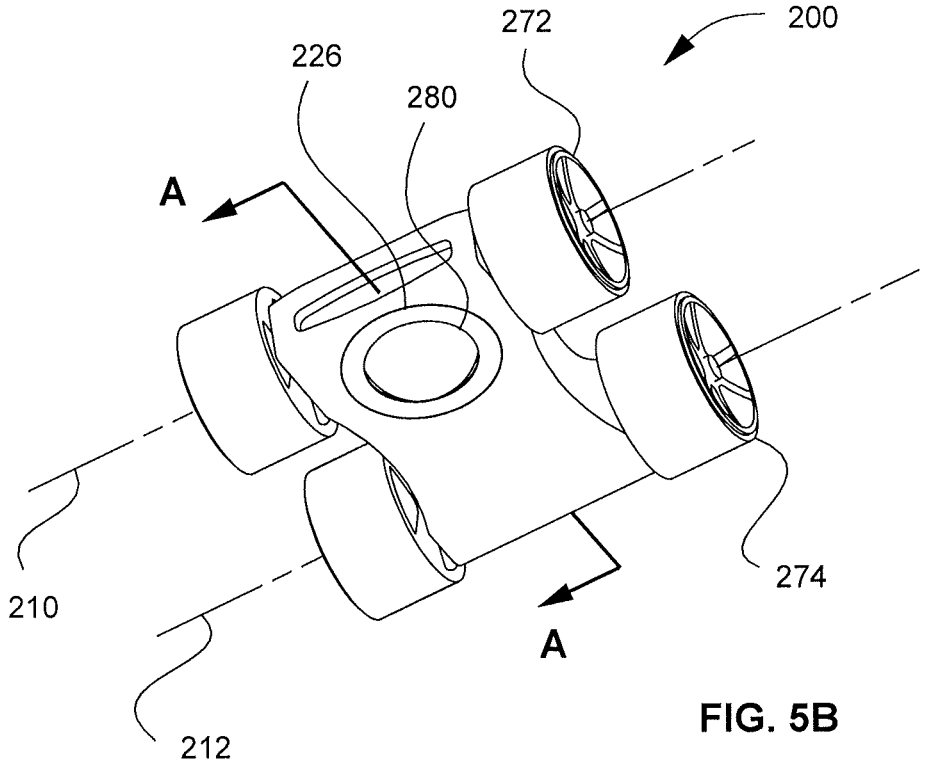
FIG. 5B shows a bottom perspective view of the embodiment shown in FIG. 5A.
Figure 5C:
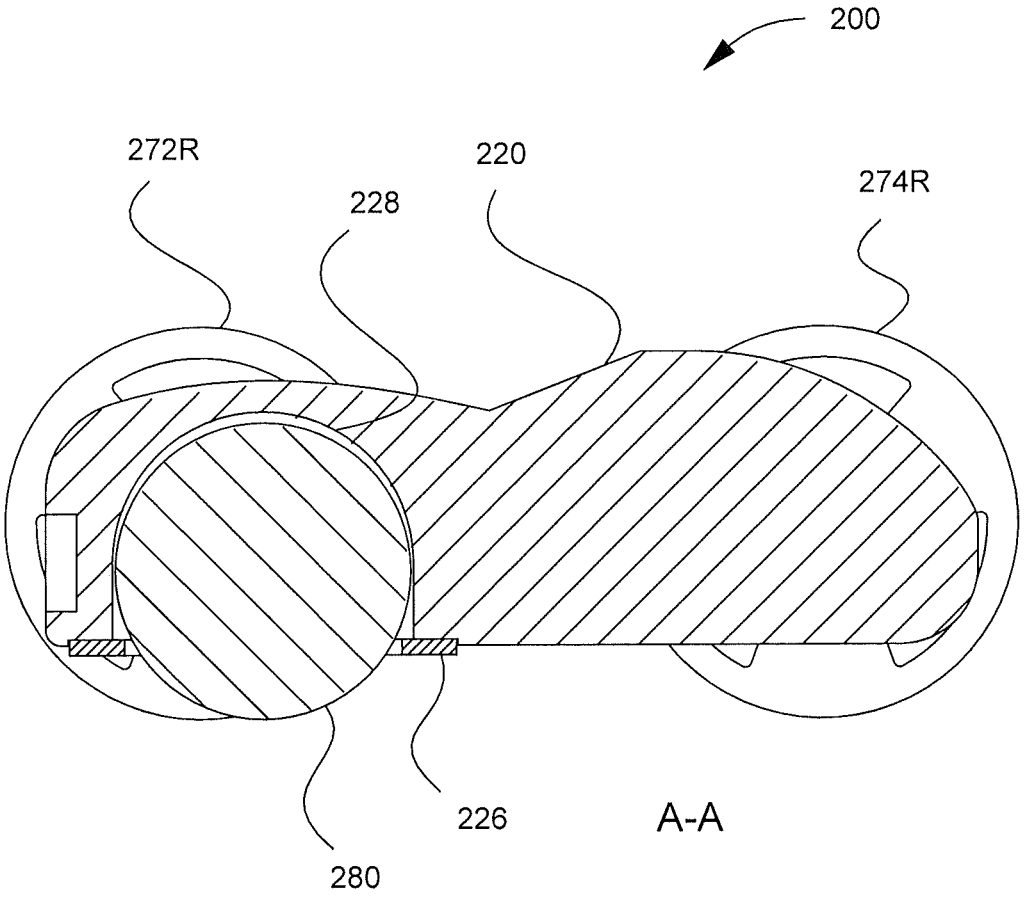
FIG. 5C shows a cross-sectional view taken along line A-A of FIG. 5B.

FIGS. 5A, 5B, 5C, and 5D show a second embodiment, toy vehicle 200, to include spherical rolling element 280. Similar to toy vehicle 100, it is preferred that all wheels of toy vehicle 200 be free-rolling and independent for best maneuvering. More specifically, front wheels 272 and rear wheels 274, are mounted to axle 282 and axle 284, respectively, to enable each wheel to roll freely and independently. Axle 282 is associated with front axis 210 and axle 284 is associated with rear axis 212. As will become apparent in subsequent discussion, spherical rolling element 280 can provide lateral forces to turn toy vehicle 200 downwardly in the direction of a slope. The contact surfaces 243 of front wheels 272 are constructed from a material adapted for lateral sliding during a turn. As an example, front wheels 272 may be constructed of plastic with a relatively low coefficient-of-friction, such as polyethylene. As will be discussed subsequently in further detail, spherical rolling element 280 is partially encapsulated within body 220 by cavity 228 and retaining element 226, as best shown in FIG. 5C. It is known in the art, that small diameter axles can allow a toy vehicle to easily roll. Therefore, it is preferable for the front wheels 272 and rear wheels 274 to substantially carry the weight of body 220 and spherical rolling element 280 to substantially carry its own weight. Therefore, toy vehicle 200 is a preferred embodiment, as shown in FIG. 5C, to have clearance above spherical rolling element 280, such that spherical rolling element 280 does not bear the weight of body 220. So that spherical rolling element 280 remains assembled with body 220, the diameter of the opening of retaining element 226 is less than the diameter of spherical rolling element 280, yet the opening of retaining element 226 is sufficiently large to allow spherical rolling element 280 to contact a play surface and bear its own weight. Alternatively, a spherical rolling element can be partially encapsulated within top portion of a toy vehicle by the vehicle's chassis, wherein a hole in the chassis is smaller than the diameter of the spherical rolling element, but large enough to permit contact of a spherical rolling element with a play surface.

In consideration of preferred geometric relationships, spherical rolling element 280 is advantageously positioned proximate to front wheels 272 to enable lateral sliding or slip of front wheels 272. More specifically, spherical rolling element 280 has a natural tendency to follow a slope downhill. When a change in slope is encountered, spherical rolling element 280 provides lateral forces, causing front wheel 272 to slip laterally, downwardly turning toy vehicle 200 toward the direction of the downward slope.

Figure 5D:
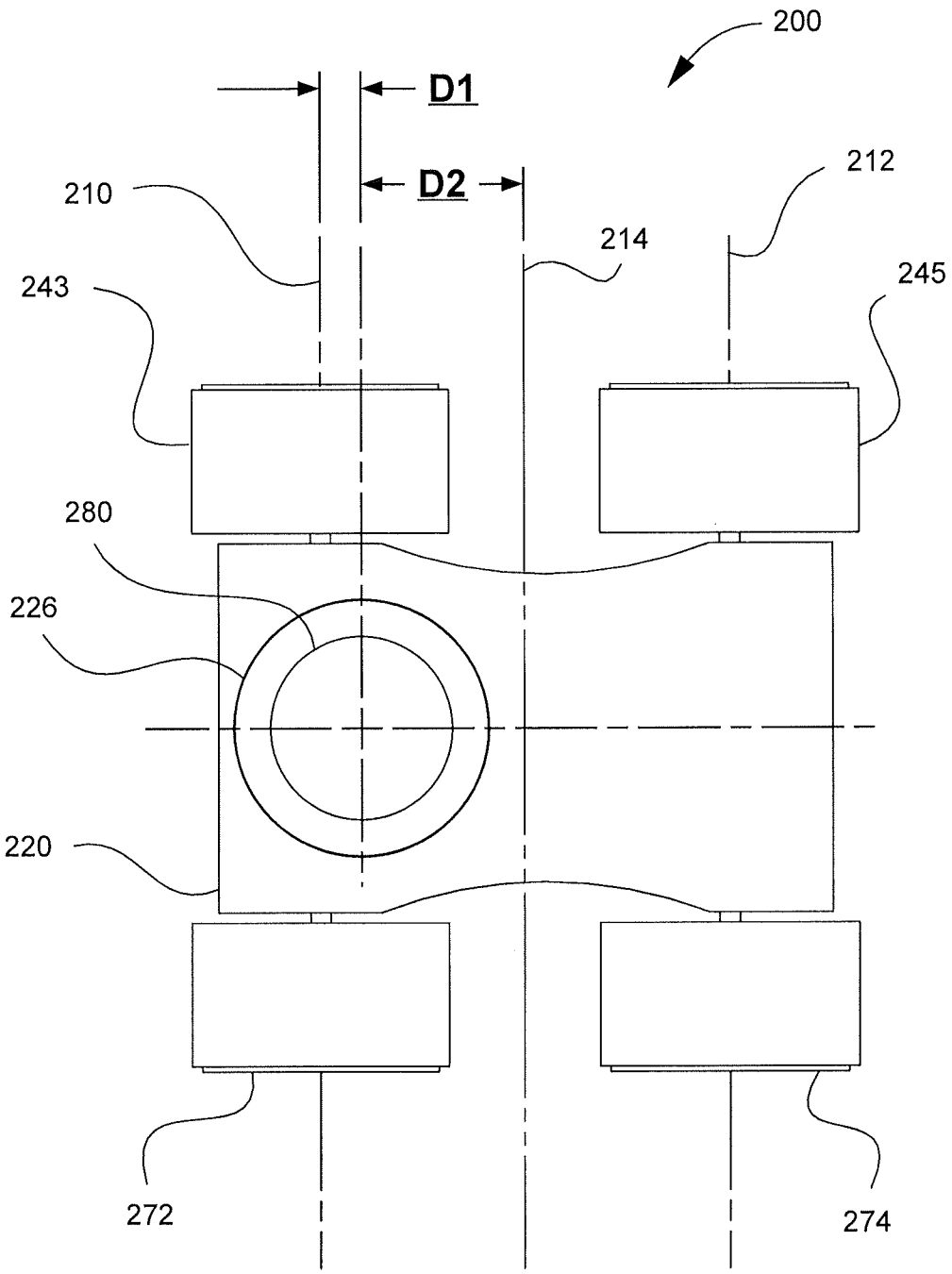
FIG. 5D is a bottom view of the embodiment shown in FIG. 5A.

Referring now to FIG. 5D, midplane 214 is centrally located between front axis 210 and rear axis 212. Spherical rolling element 280, in order to cause lateral sliding of front wheel 272 can advantageously be positioned substantially forward of midplane 214. A preferred location of the center of spherical rolling element 280 is closer to front axis 210 than midplane 214, such that distance D1 is less than distance D2, as shown in FIG. 5D. Another preferred location is when the center of spherical rolling element 280 is aligned with front axis 210 (D1=0). Finally, another preferred location of the center of spherical rolling element 280 is forward of axis 210, such that D1 would be forward of front axis 210.

Like toy vehicle 100, toy vehicle 200 is adaptable for interactive play on a play surface, such as, play surface 150, shown in FIG. 3. If an instantaneous play surface gradient has a component lateral to the direction of toy vehicle 200, spherical rolling element 280, advantageously positioned proximate to front wheels 272, places greater lateral forces at front wheels 272 relative to rear wheels 274. If contact surfaces 243 of front wheels 272 are adapted for lateral sliding, the result is rotation or turning of toy vehicle 100 toward the downward direction of a play surface gradient. Spherical rolling element 280, positioned within cavity 228, contacts and rolls across a play surface. Due to its weight and minimal rolling resistance, a metal ball bearing is a preferred component for spherical rolling element 280.

Further considering toy vehicle 200, front wheels 272 and rear wheels 274 may be identically configured. Such a configuration is more closely associated with a form of the popular "drift turning". Alternatively, toy vehicle 200 can be configured with certain functional elements of toy vehicle 100 that enable maneuverability. More specifically, contact surfaces 243 of front wheels 243 can more readily slide laterally relative to contact surfaces 245 of rear wheels 274. As an example, contact surface 243 of front wheel 272 may be a "low-friction" plastic, such as, Acetal and contact surface 245 or rear wheels 274 may be a substantially elastic polymer providing lateral grip, such as, silicone.

Figure 6A:
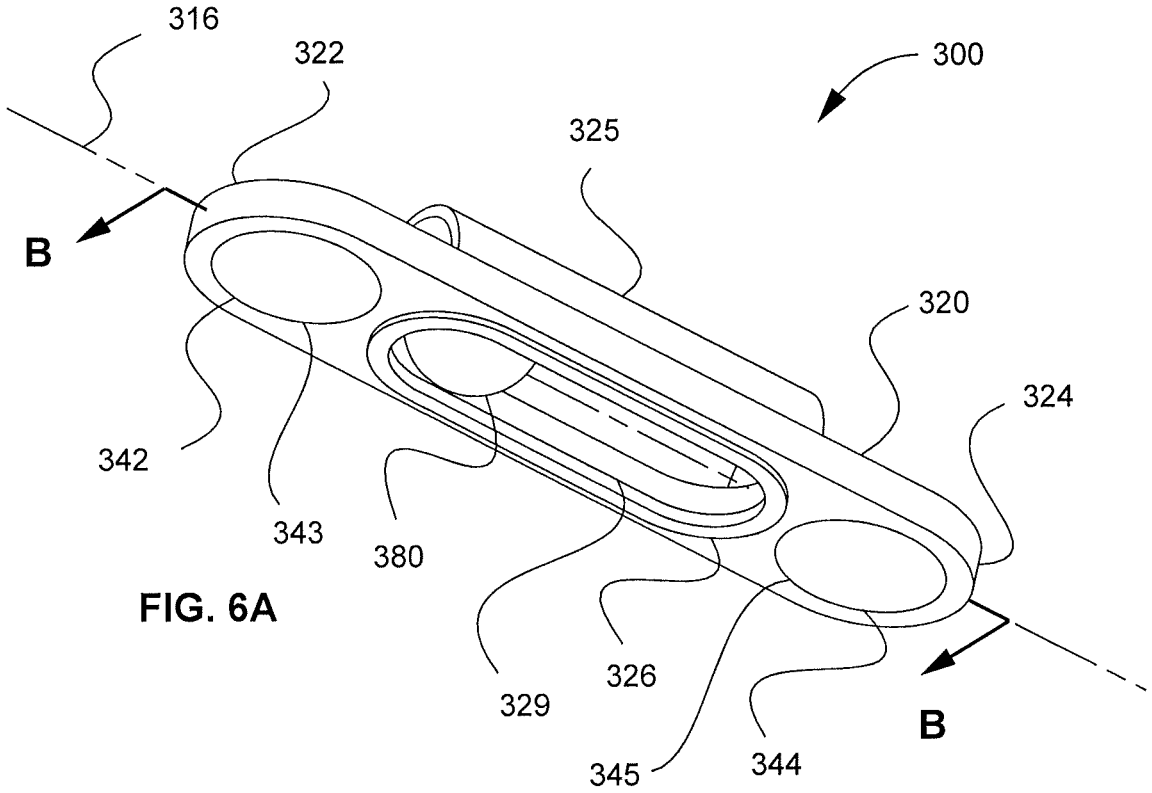
FIG. 6A is a bottom perspective view of a third embodiment of a toy vehicle to include a ball bearing moveable within a slot and two sliding elements.
Figure 6B:
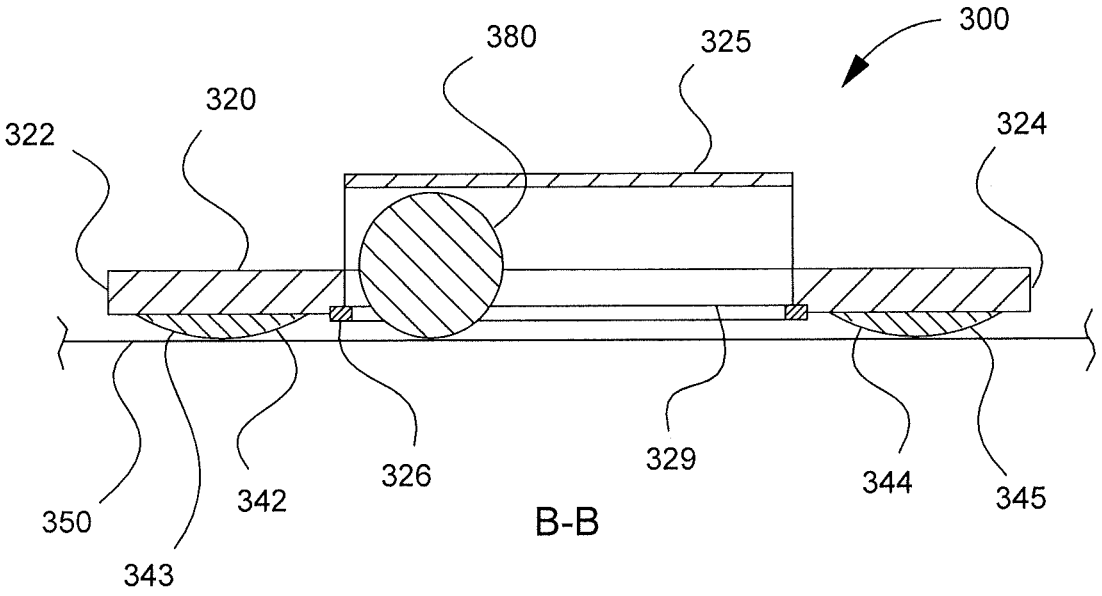
FIG. 6B shows a cross-sectional view taken along line B-B of FIG. 6A.

A toy snowboard is an example of a slidable toy vehicle where it is advantageous to have a turning bias alternating from one end of the body to the other end of the body, since it is desirable to alternate the end of the snowboard pointing downhill. FIGS. 6A and 6B show another embodiment, steerable toy vehicle 300, to include body 320, slot 329, rolling element 380, first sliding element 342, and second sliding element 344. Body 320 has a first end 322, second end 324, and housing 325. Spherical rolling element 380 is positioned within slot 329 and allowed to travel longitudinally proximate to either first sliding element 342 or second sliding element 344. It is preferred that spherical rolling element 380 be constrained within slot 329 such that it does not bear any weight of body 320. Spherical rolling element 380 supports its own weight in rolling contact with play surface 350, as shown in FIG. 6B. Retaining element 326 serves to keep spherical rolling element 380 within body 320. Because spherical rolling element 380 can travel by gravity to either end of slot 329, this configuration is intended to provide equal or similar turning bias in response to an incline with a lateral component relative to the instantaneous direction of toy vehicle 300. Similar to toy vehicle 200, toy vehicle 300 has a turning bias when spherical rolling element 380 is proximate to a sliding element, more specifically sliding element 342 or sliding element 344. Spherical rolling element 380 can cause lateral forces as spherical rolling element 380 has a tendency or bias to follow a downward slope. Sliding elements 342 and 344, preferably constructed of a low-friction plastic, are associated with contact surfaces 343 and 345, respectively. To simulate a "carving turn", contact surfaces 343 and 345 are convex to allow rotation with respect to longitudinal axis 316. In addition, a plurality of spherical rolling elements may be used within a slot. Toy vehicle 300 can be advantageously combined with an interactive play surface, such as, interactive play surface 150, shown in FIG. 3. Toy vehicle 300 may be also adaptable to a rider.

Figure 7:
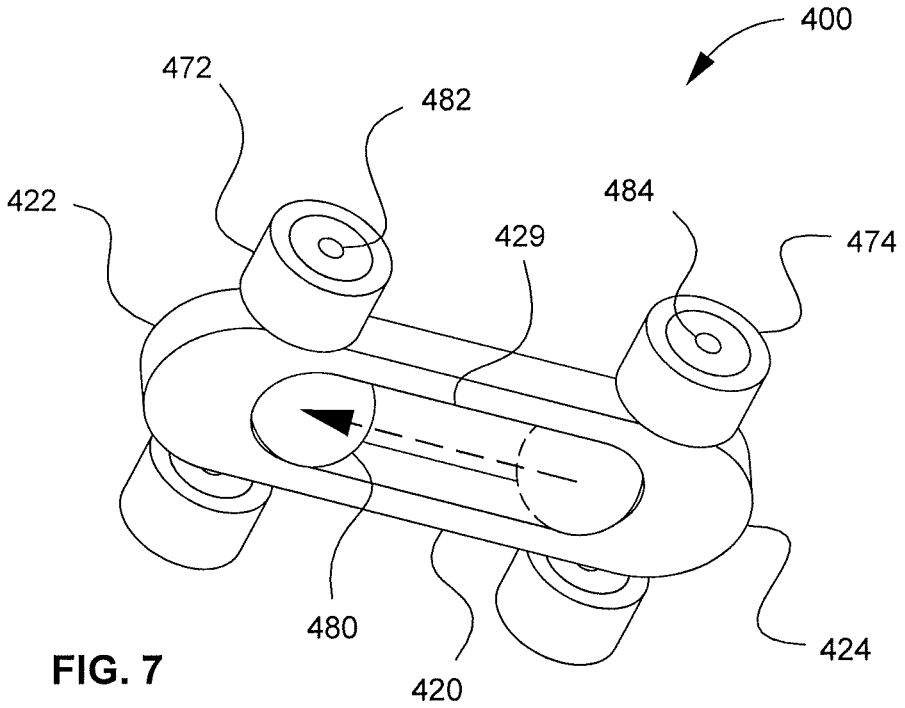
FIG. 7 shows a bottom perspective view of a fourth embodiment of a toy vehicle to include a ball bearing constrained within a slot.

An advantageous turning mechanism is desirable for wheeled toy vehicles that do not necessarily have a designated front end, such as certain types of skateboards. FIG. 7 shows another embodiment, steerable toy vehicle 400, to include body 420 with a first end 422, second end 424. First end 422 is associated with first end wheels 472 and second end 424 is associated with second end wheels 474. First end wheels 472 and second end wheels 474 are mounted to first axle 482 and second axle 484, respectively. For best maneuvering, all wheels are preferably free-rolling and independent. First end wheels 472 and second end wheels 474 are preferably configured to slide laterally with sufficient instantaneous lateral gradient and may be at least partially constructed of a plastic having a relatively low coefficient-of-friction. Spherical rolling element 480 preferably does not bear any weight of body 420, so that it may freely travel within slot 429. Spherical rolling element 480, in adaptation to an instantaneous incline, may be proximate to either first end wheels 472 or second end wheels 474. The width of the opening of slot 429 is less than the diameter of spherical rolling element 480, yet the geometric relation allows spherical rolling element 480 to contact a play surface. According to its instantaneous position within slot 429, spherical rolling element 480 has the potential to enhance lateral sliding of first end wheels 472 or second end wheels 474. As an example, when spherical rolling element 480 is proximate to first end wheels 472, steerable toy vehicle 400 has a bias to turn toward the direction of an incline leading with first end 422 due to lateral forces resulting from spherical rolling element 480 naturally tending to follow a gradient downward. Steerable toy vehicle 400 can be advantageously combined with a dynamic play surface, such as, interactive play surface 150, shown in FIG. 3.

Figure 8:
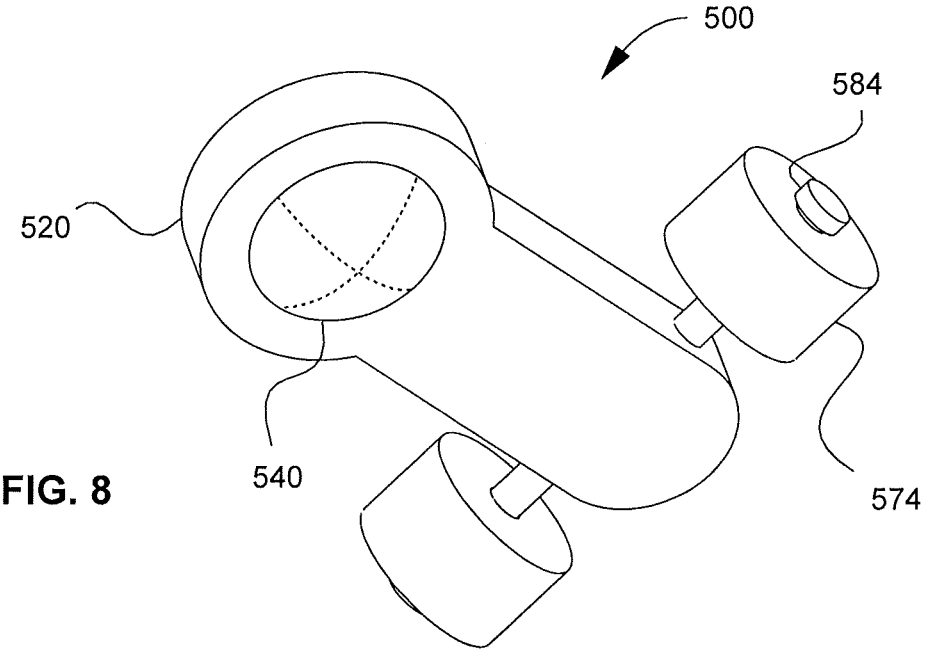
FIG. 8 is a bottom perspective view of a fifth embodiment of a toy vehicle configured with two wheels and a sliding element.

FIG. 8 shows another embodiment, steerable toy vehicle 500, to include body 520, sliding element 540, and rear wheels 574. For best maneuverability, rear wheels 574 are mounted to rear axle 584 with enough clearance to enable rear wheels 574 to roll freely and independently. Through material properties or geometry, rear wheels 574 have a greater resistance to lateral sliding relative to sliding element 540, such that steerable toy vehicle 500 has a bias to turn toward the direction incline, leading with sliding element 540. Sliding element 540 is shown as a hemispherical shape and it is typically made of a material that easily slides, having a low coefficient of friction, such as, ABS plastic. Other shapes for sliding element 540 are contemplated, such as, a disc shape. Sliding characteristics of rear wheels 574 can be accomplished thru material selection and other means, such as tread design. For example, rear wheels 574 may have a contact surface made of rubber. Steerable toy vehicle 500 can be advantageously combined with an interactive play surface, such as, interactive play surface 150, shown in FIG. 3.

Figure 9:
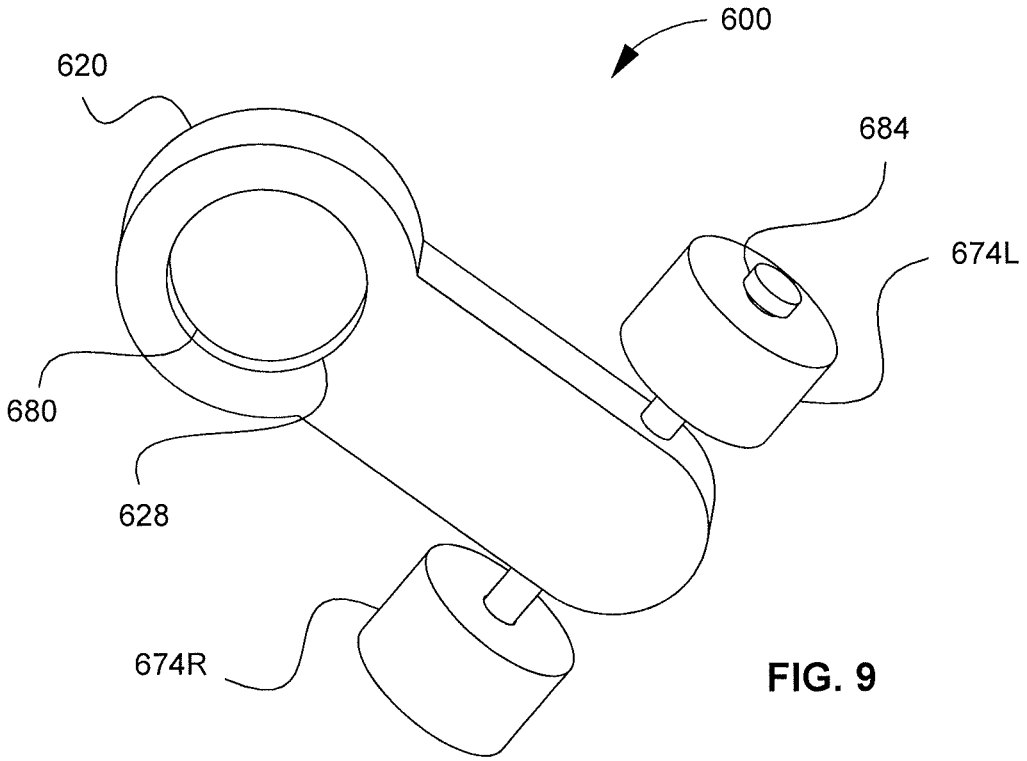
FIG. 9 is a bottom perspective view of a sixth embodiment of a toy vehicle configured with two wheels and a spherical rolling element.

FIG. 9 shows another embodiment, steerable toy vehicle 600, to include body 620, spherical rolling element 680, wheels 674L/674R, and rear axle 684. Spherical rolling element 680 is within cavity 628, such that spherical rolling element 680 supports a portion of the weight of body 620. Through material properties or geometry, wheels 674L and 674R have a greater resistance to lateral movement relative to spherical rolling element 680, thus creating the impetus for a turning bias. For example, wheels 674L and 674R may be made of rubber. Spherical rolling element 680 may be a metal ball bearing, as an example. Toy vehicle 600 has a bias to downwardly turn toward the direction of a slope, leading with spherical rolling element 680. Toy vehicle 600 can be advantageously combined with an interactive play surface, such as, interactive play surface 150, shown in FIG. 3.

Figure 10:
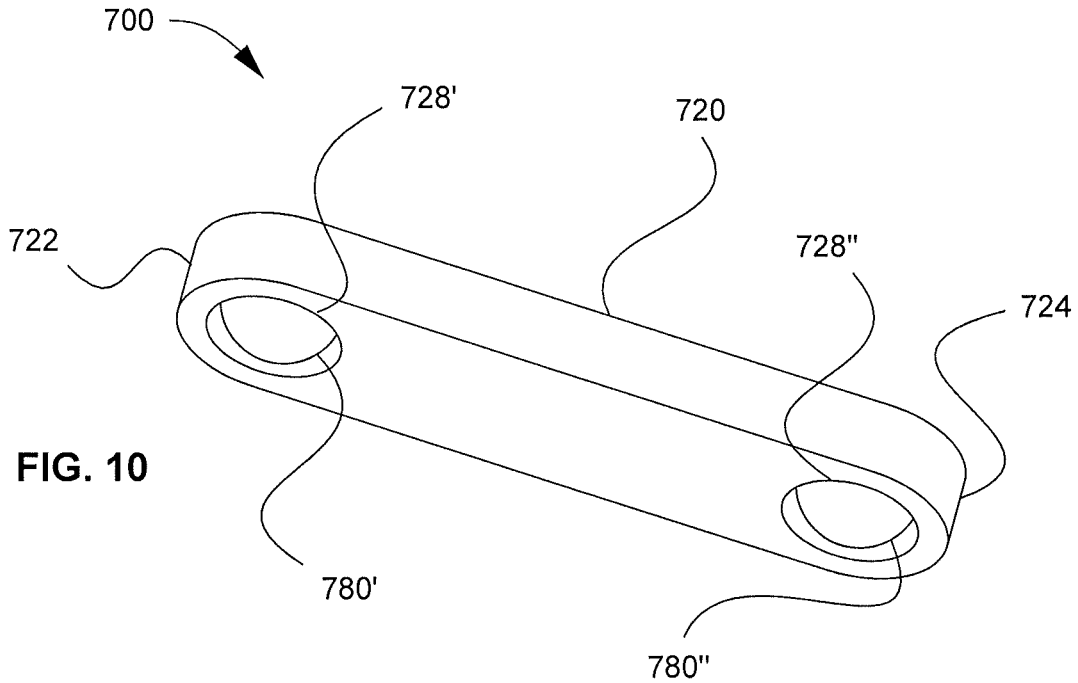
FIG. 10 is a bottom perspective view of a seventh embodiment of a toy vehicle to include a body and two spherical rolling elements.

FIG. 10 shows another embodiment, toy vehicle 700 to include body 720 and two spherical rolling elements 780' and 780", positioned proximate to first end 722 and second end 724, respectively. Spherical rolling elements 780' and 780" support the weight of body 720. Spherical rolling elements 780' and 780" articulate within first cavity 728' and second cavity 728", respectively. If surface properties of spherical rolling element 780" articulating with cavity 728" provide greater resistance to rolling (articulating) relative to spherical rolling element 780' articulating with cavity 728', then toy vehicle 700 will have a downward turning bias toward the direction of an instantaneous slope, leading with first end 722. A plurality of spherical rolling elements may also be used to provide additional support to the body of a toy vehicle. Toy vehicle 700 can be advantageously combined with an interactive play surface, such as, interactive play surface 150, shown in FIG. 3.

Figure 11:
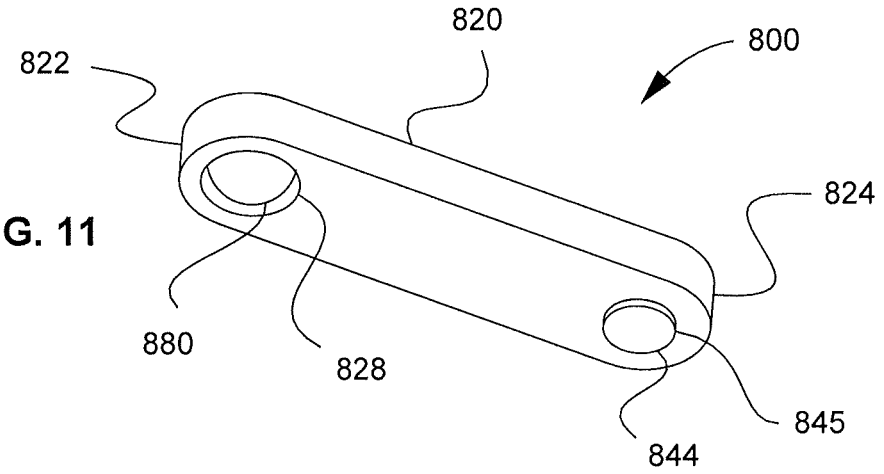
FIG. 11 is a bottom perspective view of an eighth embodiment of a toy vehicle to include a spherical rolling element and a sliding element.

FIG. 11 shows another embodiment, steerable toy vehicle 800, to include body 820 and spherical rolling element 880. Body 820 has first end 822 and second end 824, wherein first end 822 is associated with cavity 828. Sliding element 844 and associated contact surface 845 are configured to have a greater resistance to lateral movement compared to spherical rolling element 880, such that steerable toy vehicle 800 has a tendency to turn downwardly toward the direction an incline leading with first end 822. Spherical rolling element 880 is load-bearing and carries a portion of the weight of body 820. If the resistance to sliding of sliding element 844 is increased, the speed of steerable toy vehicle 800 down an incline would be reduced, but the ability to turn and pivot would be enhanced. Related to sliding element 840, sliding resistance may be tailored by using materials with select coefficient of friction, as discussed previously. Examples of material selections related to sliding elements include hard plastic (relatively fast vehicle and less maneuverable) or a felt pad (relatively slow vehicle, but more maneuverable). Toy vehicle 800 can be advantageously combined with a dynamic and interactive play surface, such as, interactive play surface 150, shown in FIG. 2.

Figure 12:
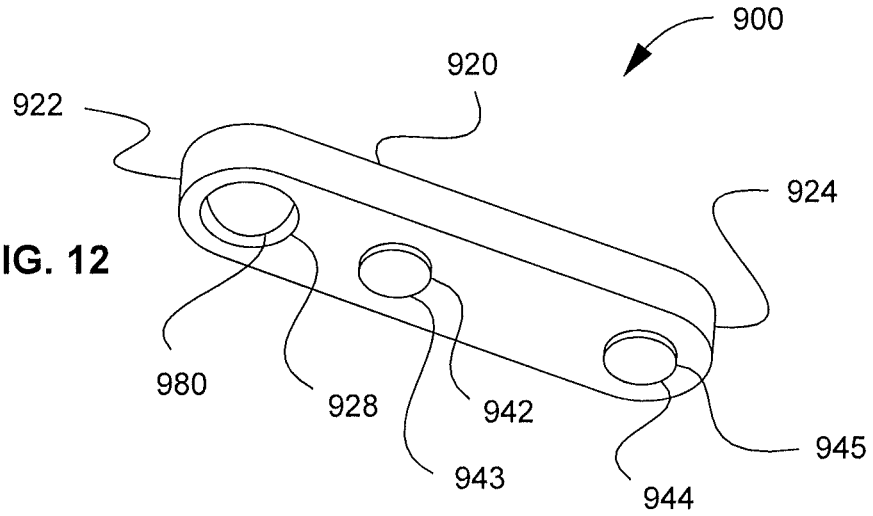
FIG. 12 is a bottom perspective view of a ninth embodiment of a toy vehicle to include a first sliding element, a second sliding element, and spherical rolling element proximate to an end of the steerable toy vehicle.

FIG. 12 shows another embodiment, toy vehicle 900, to include body 920 and spherical rolling element 980. Body 920 is associated with front portion 922, and rear portion 924, cavity 928, first sliding element 942 associated with contact surface 943, and second sliding element 944 associated with contact surface 945. Steerable toy vehicle 900 is advantageously configured to travel on a play surface exhibiting a tendency to travel downward and align its direction with the instantaneous direction of an incline. Preferably, spherical rolling element 980 does not carry the weight of body 920, but transfers forces to body 920 to enable toy vehicle to maneuver, as previously discussed. Spherical rolling element 980 is positioned in cavity 928 proximate to front portion 922 and forward of first sliding element 942 to create a bias of body 920 to turn toward the direction of an incline, leading with front portion 922. Sliding elements 942 and 944 are suitably spaced to support the weight of body 920, but a single sliding element with a sufficiently broad sliding surface portion can be used to support body 920.

Figure 13:
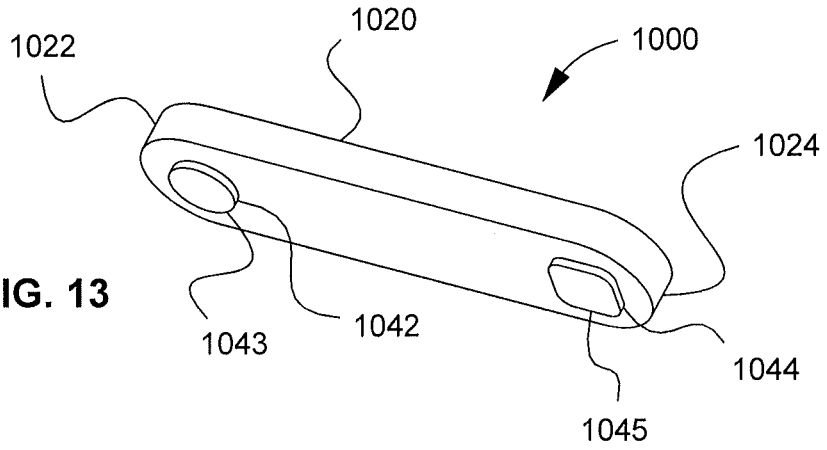
FIG. 13 is a bottom perspective view of a tenth embodiment of a toy vehicle to include a first sliding element and a second sliding element.

FIG. 13 shows another embodiment, steerable toy vehicle 1000, including body 1020, first sliding element 1042, and second sliding element 1044. Body 1020 has a first end 1022 and a second end 1024. First sliding element 1042 is associated with contact surface 1043 and second sliding element 1044 is associated with contact surface 1045. Steerable toy vehicle 1000 is advantageously configured to travel on a play surface exhibiting a tendency to downwardly align its direction of travel with the instantaneous direction of an incline. Through materials properties, surface characteristics, or geometry, first sliding element 1042 and associated first contact surface 1043 is advantageously configured to have less resistance to sliding relative to second sliding element 1042. Thus, first sliding element 1042 has a tendency to turn toy vehicle 1000 in response to an instantaneous gradient lateral to the instantaneous direction of toy vehicle 1000 with second sliding element 1042 trailing. As an example of material selection, first sliding element 1042 may be constructed of polyethylene plastic (low coefficient-of-friction) and second sliding element 1042 may be a felt pad. Toy vehicle 1000 can be advantageously combined with a tiltable play surface, such as, interactive play surface 150, shown in FIG. 3.

Although the description above contains much specificity, this should not be construed as limiting the scope of the embodiments, but merely providing illustrations of some of many possible embodiments. Although certain embodiments are intended for interactive play on a tiltable play surface, these certain embodiments can also be used on a variety of stationary play surfaces having a slope. Certain embodiments may be mounted with a motor or be propelled by motorized systems, while retaining the ability to navigate and maneuver in response to an instantaneous incline, such as, a banked turn. Thus the scope of the embodiments should be determined by the appended claims and their legal equivalents, rather than the examples given.

The invention claimed is:

1. A method of interactively controlling the speed and direction of a toy vehicle on a play surface comprising the steps of:

a) providing the toy vehicle, wherein the toy vehicle comprises:
   i) a vehicle body having a front portion extending longitudinally toward a rear portion;
   ii) a front axle rotatably coupling a front wheel with the front portion, wherein the front wheel has a front wheel contact surface having a first coefficient-of-sliding-friction;
   iii) a rear axle rotatably coupling a left rear wheel and right rear wheel with the rear portion such that left rear wheel and the right rear wheel are independently rotatable about the axle, wherein the right rear wheel has a right rear wheel contact surface having a second coefficient-of-sliding-friction and the left rear wheel has a left rear wheel contact surface having the second coefficient-of-sliding-friction; and
   iv) wherein the first coefficient-of-sliding-friction is less than the second coefficient-of-sliding-friction;

b) providing the play surface, the play surface being configured to be hand-held and freely oriented in space;

c) locating the toy vehicle on the play surface, such that each of the front wheel contact surface, the left rear wheel contact surface, and the right rear wheel contact surface contacts the play surface;

d) interactively controlling a speed and a direction of the toy vehicle on the play surface by tilting the play surface, wherein interactively tilting the play surface moves the toy vehicle forward or backward on the play surface and causes a lateral slip of the front wheel contact surface relative to the play surface to enable the toy vehicle to turn on the play surface; and e) tossing the toy vehicle above the play surface by accelerating at least a portion of the play surface upward.

2. The method of claim 1, wherein the front wheel contact surface comprises a low coefficient-of-sliding-friction plastic.

3. The method of claim 1, wherein each of the left rear wheel contact surface and the right rear wheel contact surface comprises a polymeric material selected from the group consisting of rubber, an elastomer, a rubberized plastic, and combinations thereof.

4. The method of claim 1, wherein the vehicle body has a cavity proximate to the front wheel contact surface, wherein a spherical rolling element is rotatably contained in the cavity and bears only its own weight, and wherein the spherical rolling element extends from the vehicle body to contact the play surface.

5. The method of claim 1, wherein the play surface comprises a first surface having a first inclination and a second surface having a second, upward inclination, wherein tossing the toy vehicle comprises directing the toy vehicle up the second surface and above the play surface.

6. The method of claim 5, wherein the first surface is circular, and the second surface surrounds the first surface.

7. The method of claim 1, wherein tossing the toy vehicle comprises performing an aerial maneuver with the toy vehicle.

8. A method of interactively controlling the speed and direction of a toy vehicle on a play surface comprising the steps of:

a) providing the toy vehicle, wherein the toy vehicle comprises:

i) a vehicle body having a front portion extending longitudinally toward a rear portion;

ii) a front axle rotatably coupling a front wheel with the front portion, wherein the front wheel has a front wheel contact surface having a first coefficient-of-sliding-friction;

iii) a rear axle rotatably coupling a left rear wheel and right rear wheel with the rear portion, wherein the right rear wheel has a right rear wheel contact surface having a second coefficient-of-sliding-friction and the left rear wheel has a left rear wheel contact surface having the second coefficient-of-sliding-friction;

iv) the vehicle body having a cavity proximate to the front axle; and v) a spherical rolling element rotatably positioned within the cavity, wherein the spherical rolling element bears only its own weight and extends below the vehicle body;

b) providing the play surface, the play surface being configured to be hand-held and freely oriented in space;

c) locating the toy vehicle on the play surface, such that each of the front portion contact surface, the left rear wheel contact surface, the right rear wheel contact surface, and the spherical rolling element contacts the play surface; and d) interactively controlling a speed and a direction of the toy vehicle on the play surface by tilting the play surface, wherein interactively tilting the play surface moves the toy vehicle forward or backward on the play surface and causes a lateral slip of the front wheel contact surface relative to the play surface to enable the toy vehicle to interactively turn on the play surface.

9. The method of claim 8, wherein the cavity is a longitudinal slot, and wherein the spherical rolling element is configured to traverse the longitudinal slot to be proximate to the front axle or the rear axle.

10. The method of claim 8, wherein the first coefficient-of-sliding-friction is equal to the second coefficient-of-sliding-friction, and wherein the front wheel contact surface and the rear wheel contact surface each comprise a low coefficient-of-sliding-friction plastic.

11. The method of claim 8, wherein the first coefficient-of-sliding-friction is less than the second coefficient-of-sliding-friction, wherein the front wheel contact surface comprises a low coefficient-of-sliding-friction plastic; and wherein each of the left rear wheel contact surface and the right rear wheel contact surface comprises a polymeric material selected from the group consisting of rubber, an elastomer, a rubberized plastic, and combinations thereof.

12. A method of interactively maneuvering a toy vehicle on a play surface comprising the steps of:

a) providing a toy vehicle, wherein the toy vehicle comprises:

i) a body having a first end extending longitudinally toward a second end;

ii) a front axle positioned proximate the first end of the body of the toy vehicle;

iii) at least one front wheel, the at least one front wheel being rotatably coupled with the front axle, the at least one front wheel having a front wheel contact surface having a first coefficient-of-sliding-friction;

iv) a rear axle positioned proximate the second end of the body of the toy vehicle;

v) a left rear wheel, the left rear wheel being rotatably coupled with the rear axle, and the left rear wheel having a left rear wheel contact surface having a second coefficient-of-sliding-friction;

vi) a right rear wheel, the right rear wheel being rotatably coupled with the rear axle, and the right rear wheel having a right rear wheel contact surface having the second coefficient-of-sliding-friction; and vii) wherein the first coefficient-of-sliding-friction is less than the second coefficient-of-sliding-friction;

b) providing a play surface, the play surface being configured to be hand-held and freely oriented in space;

c) locating the toy vehicle on the play surface, wherein each of the front wheel contact surface, the left rear wheel contact surface, and the right rear wheel contact surface contacts the play surface;

d) interactively controlling a speed and a direction of the toy vehicle on the play surface by tilting the play surface, wherein interactively controlling the speed and the direction of the toy vehicle comprises performing a rapid turnaround of the toy vehicle such that a lateral slip of the front wheel contact surface of the at least one front wheel on the play surface purposefully turns the toy vehicle on the play surface from a first direction to a second direction, wherein the second direction is substantially opposite the first direction, and wherein the left rear wheel and the right rear wheel spin in opposite directions during the rapid turnaround.

13. The method of claim 12, wherein the front wheel contact surface is plastic.

14. The method of claim 12, wherein the left rear wheel contact surface and the right rear wheel contact surface each comprise a polymeric material selected from the group consisting of rubber, an elastomer, a rubberized plastic, and combinations thereof.

15. The method of claim 12, wherein the toy vehicle has two opposing sides and is configured to operate with either of the two opposing sides facing the play surface.

16. The method of claim 12, wherein the body has a cavity proximate to the first end, wherein a spherical rolling element is positioned with the cavity, such that the spherical rolling element is rotatable relative to the body and bears only its own weight, and wherein the spherical rolling element extends from the body to contact the play surface.

17. The method of claim 12, wherein the play surface comprises a first surface having a first inclination and a second surface having a second, upward inclination, wherein a portion of the second surface defines an outer edge of the play surface.

* * * * *